US008640515B2

(12) United States Patent
Späni

(10) Patent No.: US 8,640,515 B2
(45) Date of Patent: Feb. 4, 2014

(54) BAR FOR CONNECTING THE TWO CYLINDERS HALVES OF A VARIABLE-LENGTH DOUBLE CYLINDER LOCK

(75) Inventor: Urs Späni, Schindellegi (CH)

(73) Assignee: Assa Abloy (Schweiz) AG, Richterswil (CH)

( * ) Notice: Subject to any disclaimer, the term of this patent is extended or adjusted under 35 U.S.C. 154(b) by 202 days.

(21) Appl. No.: 12/867,839

(22) PCT Filed: Feb. 3, 2009

(86) PCT No.: PCT/CH2009/000040

§ 371 (c)(1),
(2), (4) Date: Aug. 16, 2010

(87) PCT Pub. No.: WO2009/100548

PCT Pub. Date: Aug. 20, 2009

(65) Prior Publication Data

US 2010/0319421 A1 Dec. 23, 2010

(30) Foreign Application Priority Data

Feb. 14, 2008 (EP) ..... 08405040

(51) Int. Cl.
*E05B 9/04* (2006.01)

(52) U.S. Cl.
USPC ..... 70/373; 70/374; 70/391; 70/451; 70/461; 70/DIG. 60

(58) Field of Classification Search
USPC ..... 70/372, 373, 374, 493, DIG. 60, 370, 70/391, 448, 451, 461
See application file for complete search history.

(56) References Cited

U.S. PATENT DOCUMENTS

| | | | | | |
|---|---|---|---|---|---|
| 2,381,136 | A * | 8/1945 | Oxhandler | ..... | 70/374 |
| 3,293,892 | A * | 12/1966 | Falk | ..... | 70/493 |
| 4,292,824 | A * | 10/1981 | Keller | ..... | 70/373 |
| 5,479,801 | A * | 1/1996 | Keller | ..... | 70/373 |
| 5,666,835 | A * | 9/1997 | Keller | ..... | 70/397 |
| 7,059,160 | B2 * | 6/2006 | Keller | ..... | 70/375 |
| 7,591,160 | B2 * | 9/2009 | Keller | ..... | 70/277 |
| 2008/0087060 | A1 | 4/2008 | Butt | | |

FOREIGN PATENT DOCUMENTS

| | | | |
|---|---|---|---|
| DE | 19646058 | A1 | 5/1998 |
| DE | 10060130 | A1 | 6/2002 |
| EP | 0736653 | A2 | 10/1996 |
| EP | 1201852 | A2 | 5/2002 |
| WO | WO0216712 | A2 | 2/2002 |
| WO | WO2004099535 | A1 | 11/2004 |
| WO | WO2006063396 | A1 | 6/2006 |

* cited by examiner

*Primary Examiner* — Christopher Boswell
(74) *Attorney, Agent, or Firm* — Browdy and Neimark, PLLC

(57) ABSTRACT

The bar has two arms (12, 13) which can each be inserted into a recess (6) of the housing (2) of one of the two cylinder halves (1). The arms (12, 13) each have several drilled holes to accommodate attachment pins. The bar has a middle part (9) as base element and at least one extension part (16). The middle part (9) and the extension part (16) can be interconnected and each has at least one drilled hole (15, 21) to accommodate a connecting pin (30).

11 Claims, 3 Drawing Sheets

Figure 1:
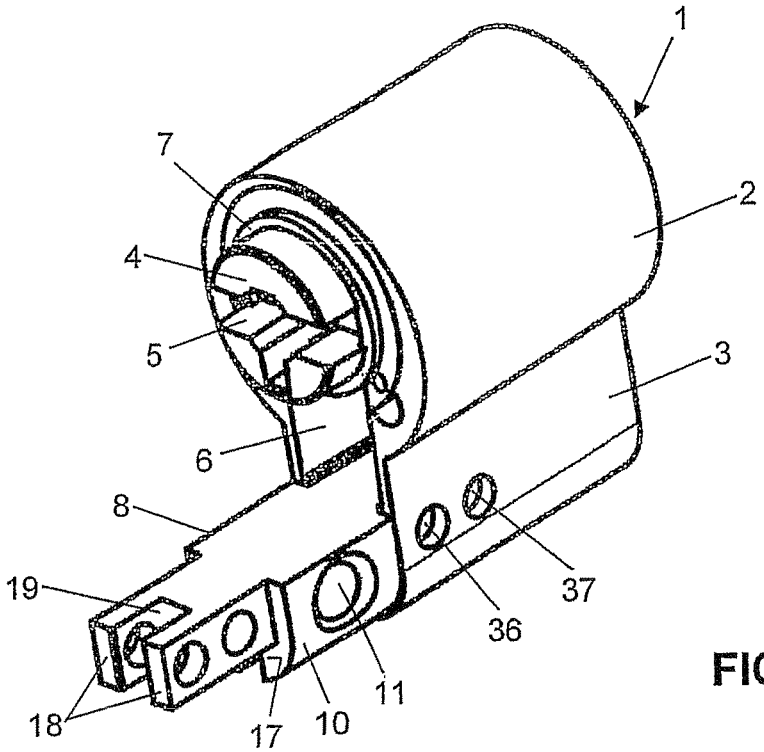

BAR FOR CONNECTING THE TWO CYLINDERS HALVES OF A VARIABLE-LENGTH DOUBLE CYLINDER LOCK

The invention relates to a bar for connecting the two cylinder halves of a variable-length double locking cylinder, having two arms which can respectively be inserted into a recess of the housing of one of the two cylinder halves and have a plurality of boreholes for the reception of fastening pins, and having a thickened part which is arranged between the arms and to which the cylinder halves can be applied.

Such bars have long been known. They generally consist of a very strong and flexurally stable material, so that the outside cylinder halves cannot be torn off in a break-in attempt. Variable-length double locking cylinders are also known. In these, the two cylinder halves can respectively be extended with an extension part. For this, appropriate construction kits having a plurality of such extension parts are also known. Correspondingly, bars of different length are here required. This calls for a very complex stockkeeping with a large number of parts, in particular also many different-length bars.

A bar of said type and a variable-length double locking cylinder have become known in the prior art by virtue of WO 2004/099535. The bar is respectively connected by the arms, with two through-pins, to a respective cylinder half. The two arms of the bar respectively possess a plurality of boreholes for the reception of these pins.

DE 100 60 130 A1 discloses a modular system for assembling double locking cylinders. Here too, bars are provided which possess a plurality of boreholes on each arm. Here too, a large number of different bars are necessary in accordance with the possible lengths of the double locking cylinder.

DE 196 46 058 A1 discloses an extendable locking cylinder modular system, in which the housings of the cylinder halves have plug-together parts. This modular system calls for special housing parts.

In addition, a bar is also known which can respectively be cut to length at the ends in accordance with the length of the double locking cylinder. A drawback with this is the comparatively large material wastage and the corresponding costs.

The object of the invention is to provide a bar of said type which avoids the stated drawbacks. The bar should thus allow a simpler and more cost-effective stockkeeping and nevertheless be functionally reliable and simple to produce.

In a bar of the generic type, the object is achieved by virtue of the fact that it has a middle part as the basic element and at least one extension part, that the middle part and the extension part can be plugged together and respectively have a borehole for the reception of a connecting pin. The bar according to the invention thus consists of parts which can be plugged together and can be connected to each other with a pin. One part is a middle part and the other part an extension part. The middle part forms a basic element and possesses a thickened part, in which, preferably, a forend screw hole is arranged. The bar can in principle comprise merely the middle part or the basic element. On the middle part, one or the other arm can be extended by the length of an extension part. However, also both arms of the middle part can respectively be extended by the length of an extension part. It has been shown that, with very few different-length middle parts and with same-length extension parts, all standard double locking cylinders can be assembled. Since the middle part and the extension part can be plugged together and can be connected to each other with a connecting pin, high stability and security is ensured.

Preferably, the bar is connected to the cylinder halves respectively with two connecting pins. One of these pins is then in each case the pin which connects the middle part to an extension part. At the same time, this pin connects the bar to the cylinder half. The middle part possesses in each arm at least two boreholes. The bar can thus also consist merely of this middle part, each cylinder half being connectable to this middle part with two pins.

The invention additionally relates to a construction kit for producing a said bar. This comprises a plurality of different-length middle parts and a plurality of extension parts, as well as a plurality of connecting pins. The extension parts are preferably all equally long. This is not essential, however. The boreholes of the middle parts and the boreholes in the connecting pins are preferably arranged in the same grid pattern.

According to one refinement of the invention, it is provided that a connecting pin is provided, which is intended for the provisional connection of a middle part to an extension part. When the connecting pin is inserted into the corresponding borehole of the cylinder half, this provisional connecting pin is ejected. This substantially simplifies the assembly.

The double locking cylinder having a bar of said type is characterized in that the two cylinder halves respectively have in a lower region of the housing at least one through-borehole running transversely to the longitudinal direction of the bar. At least one pin connects the middle part to an extension part. The boreholes in the housings of the cylinder half and in the middle part, as well as in the extension part, are preferably arranged such that, in the double locking cylinder, the cylinder halves respectively bear against a stop face of the thickened part. This increases the stability of the double locking cylinder.

Further advantageous features emerge from the dependent patent claims, the following description and the drawing.

Figure 2:
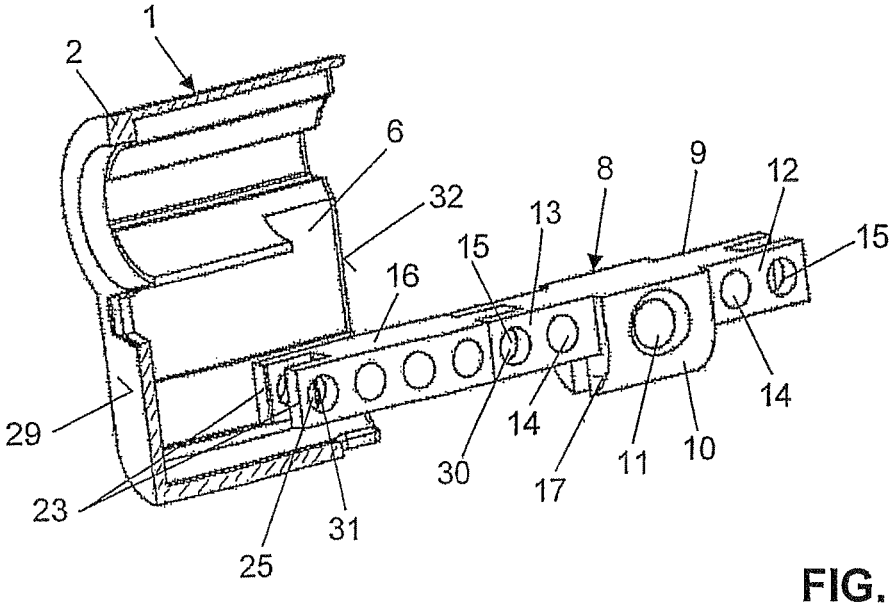
Figure 3A:
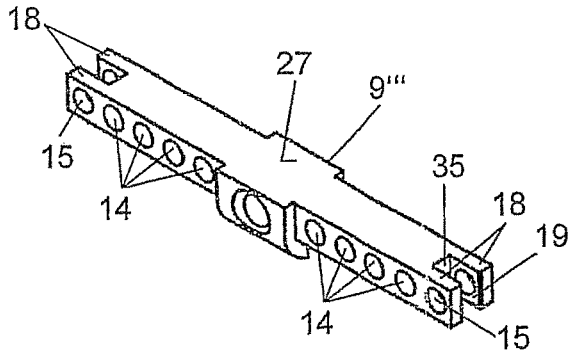
Figure 3B:
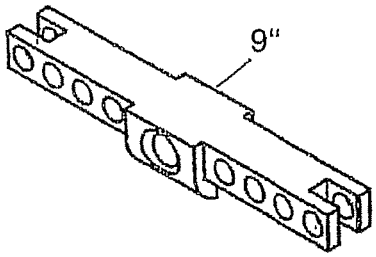
Figure 3C:
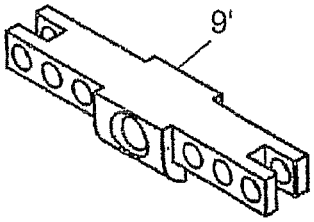
Figure 3D:
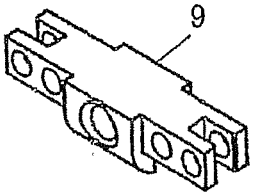
Figure 4:
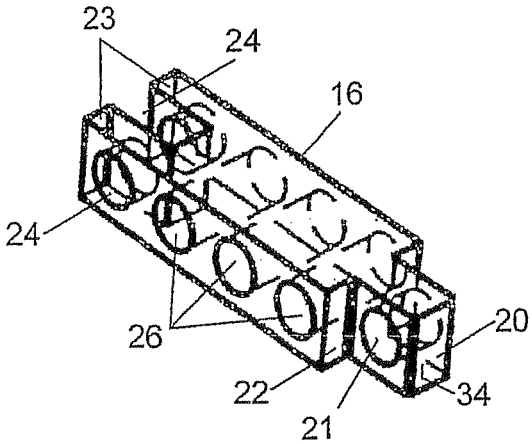
Figure 5:
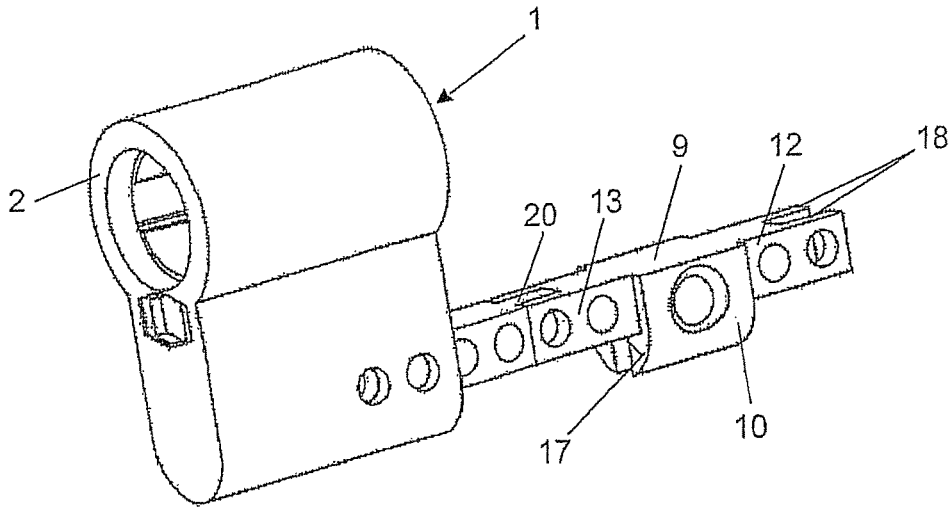

An illustrative embodiment of the invention is explained in greater detail below with reference to the drawing, wherein:

FIG. 1 shows schematically a three-dimensional view of a cylinder half having an inserted bar, FIG. 2 shows a section through a cylinder half and a view of an extended bar, FIGS. 3*a-d* show three-dimensional views respectively of a middle part, which middle parts are different in length, FIG. 4 shows a three-dimensional view of an extension part, and FIG. 5 shows a three-dimensional view according to FIG. 2, the cylinder half not being sectioned.

FIGS. 1 to 3 show a cylinder half 1 of a double locking cylinder. The cylinder half 1 is connected by a bar 8 to a second cylinder half (not shown here). This second cylinder half can be of the same configuration as the cylinder half 1 shown in FIGS. 1 and 2. The second cylinder half can also, however, be comparatively different in length from the shown cylinder half 1, or have a different actuation.

The cylinder half 1 usually possesses a housing 2 having a cylinder sack 3, in which a rotor 4 is mounted. The rotor 4 possesses in a known manner a key channel 28, which is open on a front side 29. On the rear-side end shown in FIG. 1, the rotor 4 possesses a slot 5, by which the rotor 4 is connectable to a lock bit (not shown here).

The housing 2 possesses in the lower region, and more particularly in the region of the cylinder sack 3, a recess 6, which on a rear side 32 of the housing 2 is open. This recess 6 can receive components (not shown here), for example electronic components. Attached to the rear side 2 is an extension part (not shown here). The extension part extends the recess 6 correspondingly. In the recess 6 is inserted, according to FIG. 2, an arm 13 of a middle part 9. A second, opposite arm 12 is inserted correspondingly in the second cylinder half. Located between the two arms 12 and 13 is a thickened part 10, which possesses a forend screw hole 11. With such a forend screw hole 11, the double locking cylinder can be fastened in a known manner in a door lock. The thickening 10 possesses opposite stop faces 17, against which the thickened part 10 respectively bears on the rear side 32 of the extension part. This extension part is thus located between the rear side 32 and one of the two stop faces 17. That part of the cylinder half 1 which is shown in FIG. 2 is thus extended by the extension up to the stop face 17 shown on the right in FIG. 2.

The middle part 9 possesses on each arm 12 and 13 a borehole 14 and respectively an outermost borehole 15, as well as a top side 27. The boreholes 15 pass respectively through two connecting lugs 18. Located between these two connecting lugs 18 is a recess 19, which is configured as a slot. The recess 19 is open to the top, to the bottom and also to the front. The recess 19 could also, however, be otherwise configured. For example, the recess 19 could be configured as a blind borehole extending in the longitudinal direction of the middle part 9.

The boreholes 15, and in each case a recess 19, serve for the connection of the middle part 9 to an extension part 16. The extension part 16 possesses, according to FIG. 4, a protrusion 20, which is configured correspondingly to the recess 19. Passing through the protrusion 20 is a borehole 21, which, when the protrusion 20 is fully inserted in the recess 19, is aligned with the corresponding borehole. In the assembled state, the stop faces 22 of the extension part 16 bear against the connecting lug 18. The equivalent applies to the front side 34, which bears against a face 35 in the recess 19.

The extension part 16 possesses the same cross section as the arms 12 and 13, as well as three boreholes 26. In addition, the extension part 16 possesses two connecting lugs 23, which are configured substantially the same as the connecting lugs 18. Moreover, between the connecting lugs 23 there is arranged a recess 24, which is of the same configuration as the recess 19. Passing through the connecting lugs 23 is a borehole 25. The grid pattern of the boreholes 21, 25 and 26 corresponds to the grid pattern of the boreholes 14 and 15.

The bar 8' shown in FIG. 2 is extended in relation to the bar 8 of FIG. 1 by the length of the extension part 16. The extension part 16 is mounted on the arm 13 and is fixedly connected thereto with a pin 30. The pin 30 thus connects the arm 13 to the extension part 16. A second pin 31 passes through a second borehole 37 of the cylinder sack 3, as well as through the borehole 25 of the extension part 16. The bar 8' is thus fixedly connected to the cylinder half 1 with the pin 30. Since the pin 31 also engages in the borehole 37 of the housing 2, it is correspondingly longer than the pin 30. Preferably, the housing 2 has a further borehole 36, in which a pin (not shown here) is inserted, which likewise passes through a borehole of the bar 8. The bar 8 is thus anchored in the housing 2 with two pins. It is thus possible, without reducing the stability, to diminish the cross section of the corresponding arm 12 or 13 and, correspondingly, to provide a larger recess 6 for the accommodation of components.

FIGS. 3*a*-3*d* show middle parts 9, 9', 9" and 9'", which are different in length. These middle parts can respectively be connected without an extension, or with one extension part 16, or with two or, indeed, more than two extension parts 16. The extension can thus be constructed from a plurality of pinned-together extension parts 16. A suitable module for the creation of bars 8 could thus comprise the middle parts 9 shown in FIGS. 3*a*-3*d*, as well as connecting parts 16 and corresponding bolts 30 and 31. Likewise, provisional pins (not shown here) are preferably provided, with which the extension part 16 can be provisionally connected to a middle part 9. This provisional pin is ejected when the pin 30 is inserted.

The invention enables a multiplicity of different bars to be produced from comparatively few middle parts 9, 9', 9" and 9'" and with small material loss. The middle part 9', 9" or 9'" can be shortened on one or both arms 12 and 13, by detachment of the two connecting lugs 18. For example, a bar is possible, in which one arm has only two boreholes and the other arm has thirteen boreholes. This is possible by detaching the two connecting lugs 18 on one arm of the middle part and extending the other arm with two extension parts 16.

REFERENCE SYMBOL LIST

1 cylinder half
2 housing
3 cylinder sack
4 rotor
5 slot
6 recess
7 locking ring
8 bar
9 middle part
10 thickened part
11 forend screw hole
12 arm
13 arm
14 borehole
15 borehole
16 extension part
17 stop face
18 connecting lugs
19 recess
20 protrusion
21 borehole
22 stop face
23 connecting lugs
24 recess
25 borehole
26 borehole
27 top side
28 key channel
29 front side
30 pin
31 pin
32 rear side
33 line
34 front side
35 face
36 borehole
37 borehole

The invention claimed is:

1. A bar for connecting two cylinder halves of a variable-length double locking cylinder, comprising:

a middle part comprising:

two arms which can respectively be inserted into a recess of the housing of one of the two cylinder halves, each arm having a plurality of boreholes for the reception of fastening pins, said plurality of boreholes all extending in the same direction through said middle part perpendicular to the longitudinal direction of said bar, a thickened part arranged between the arms and to which the cylinder halves can be applied, wherein the bar further comprises at least one extension part, and wherein the middle part has at least two connecting lugs, said lugs forming a second end of each of said arms, each lug having a borehole, wherein the extension part has a protrusion possessing a borehole which can be inserted between the connecting lugs for connection of the middle part to the extension part, wherein said borehole of the protrusion extends in the same direction as said plurality of boreholes in the middle part, and wherein said extension part comprises, opposite to the protrusion, at least two connecting lugs which are configured substantially the same as the connecting lugs of the middle part.

2. The bar as claimed in claim 1, wherein the boreholes of the middle part and the boreholes of the extension part are arranged in a same grid pattern.

3. The bar as claimed in claim 1, wherein the middle part has two arms having respectively at least two boreholes.

4. The bar as claimed in claim 1, wherein the extension part has at least two boreholes.

5. A construction kit for producing a bar as claimed in claim 1, further comprising a plurality of different-length middle parts and a plurality of connecting parts, as well as a plurality of connecting pins.

6. The construction kit as claimed in claim 5, further comprising connecting pins for provisionally connecting the middle parts to the extension parts.

7. A double locking cylinder having a bar as claimed in claim 1, wherein the two cylinder halves respectively have in a lower region of the housing at least one through-borehole running transversely to the longitudinal direction of the bar.

8. The double locking cylinder as claimed in claim 7, wherein the thickened part of the bar has a threaded borehole for a forend screw.

9. The double locking cylinder as claimed in claim 7, wherein the at least one extension part has a first end having a recess and a second end having a protrusion, the protrusion being configured correspondingly to the recess to enable two of said at least one extension parts to be connected together by insertion of the protrusion into the recess.

10. The double locking cylinder as claimed in claim 7, wherein at least one cylinder half has two mutually spaced through-boreholes, and a pin respectively passes through these through-boreholes and through aligned boreholes of the bar.

11. The double locking cylinder as claimed in claim 1, wherein in the assembled state, the boreholes of said at least two connection lugs and said borehole of the protrusion extend in the same direction as said plurality of boreholes in the middle part.

* * * * *